US005933953A

United States Patent [19]

Spencer et al.

[11] Patent Number: 5,933,953

[45] Date of Patent: Aug. 10, 1999

[54] METHOD OF MANUFACTURING A HEAT TRANSFER TUBE

[75] Inventors: Steven J. Spencer; Neelkanth S. Gupte, both of Liverpool, N.Y.

[73] Assignee: Carrier Corporation, Syracuse, N.Y.

[21] Appl. No.: 08/814,471

[22] Filed: Mar. 17, 1997

[51] Int. Cl.[6] ..... B23P 15/26

[52] U.S. Cl. ..... 29/890.05; 29/890.053; 29/727

[58] Field of Search ..... 29/890.048, 890.05, 29/890.053, 727

[56] References Cited

U.S. PATENT DOCUMENTS

| | | | |
|---|---|---|---|
| 4,577,381 | 3/1986 | Sato et al. | 29/890.048 |
| 4,660,630 | 4/1987 | Cunningham et al. | 29/890.048 |
| 4,765,058 | 8/1988 | Zohler | 29/890.048 |

*Primary Examiner*—I Cuda

[57] ABSTRACT

A method of manufacturing a heat transfer tube (10) having an external surface that is configured for enhanced heat transfer performance in both refrigerant evaporating and condensing applications. The tube is suitable for use in, for example, shell and tube type air conditioning condensers, flooded evaporators, falling film evaporator, or a combination of flooded and falling film evaporator. The tube has at least one fin convolution (20) extending helically around its external surface (13). A pattern of notches (30) extends at an oblique angle ($\alpha$) across the fin convolutions at intervals about the circumference of the tube. There is a split spike (22) having two distal tips (23) between each pair of adjacent notches. The fin convolution, notches and split spikes are formed in the tube by rolling the wall of the tube between a mandrel and, first, a gang of finning disks (63), second, a notching wheel (66) and third, a splitter wheel (67). Because of the interaction of the rotating and advancing tube and the notching wheel, during the manufacture of the tube, the maximum width ($W_t$) of the spike is greater than the width ($W_r$) of the proximal portion of the fin convolution.

1 Claim, 3 Drawing Sheets

METHOD OF MANUFACTURING A HEAT TRANSFER TUBE

BACKGROUND OF THE INVENTION

The present invention relates generally to heat transfer tubes. In particular, the invention relates to the method of manufacturing the refrigerant surface configuration of a heat transfer tube that is suitable for use in air conditioning and refrigeration system heat exchangers in both evaporating and condensing applications.

A shell and tube type heat exchanger has a plurality of tubes contained within a shell. The tubes are usually arranged to provide multiple parallel flow paths for one of two fluids between which it is desired to exchange heat. In a flooded evaporator, the tubes are immersed in a second fluid that flows through the heat exchanger shell. Heat passes from the one fluid to the other fluid through the walls of the tube. Many air conditioning systems contain shell and tube type heat exchangers. In air conditioning applications, a fluid, commonly water, flows through the tubes and refrigerant flows through the heat exchanger shell. In an evaporator application, the refrigerant cools the fluid by heat transfer from the fluid through the walls of the tubes. The transferred heat vaporizes the refrigerant in contact with the exterior surface of the tubes. In a condenser application, refrigerant is cooled and condenses through heat transfer to the fluid through the walls of the tubes. The heat transfer capability of such a heat exchanger is largely determined by the heat transfer characteristics of the individual tubes. The external configuration of an individual tube is important in establishing its overall heat transfer characteristics.

There are a number of generally known methods of improving the efficiency of heat transfer in a heat transfer tube. One of these is to increase the heat transfer area of the tube. One of the most common methods employed to increase the heat transfer area of a heat exchanger tube is by placing fins on the outer surface of the tube. Fins can be made separately and attached to the outer surface of the tube or the wall of the tube can be worked by some process to form fins on the outer tube surface.

In a refrigerant condensing application, in addition to the increased heat transfer area, a finned tube offers improved condensing heat transfer performance over a tube having a smooth outer surface for another reason. The condensing refrigerant forms a continuous film of liquid refrigerant on the outer surface of a smooth tube. The presence of the film reduces the heat transfer rate across the tube wall. Resistance to heat transfer across the film increases with film thickness. The film thickness on the fins is generally less than on the main portion of the tube surface due to surface tension effects, thus lowering the heat transfer resistance through the fins.

In a refrigerant evaporating application, increasing the heat transfer area of the tube surface also improves the heat transfer performance of a heat transfer tube. In addition, a surface configuration that promotes nucleate boiling on the surface of the tube that is in contact with the boiling fluid improves performance. In the nucleate boiling process, heat transferred from the heated surface vaporizes liquid in contact with the surface and the vapor forms into bubbles. Heat from the surface superheats the vapor in a bubble and the bubble grows in size. When the bubble size is sufficient, surface tension is overcome and the bubble breaks free of the surface. As the bubble leaves the surface, liquid enters the volume vacated by the bubble and vapor remaining in the volume has a source of additional liquid to vaporize to form another bubble. The continual forming of bubbles at the surface, the release of the bubbles from the surface and the rewetting of the surface together with the convective effect of the vapor bubbles rising through and mixing the liquid result in an improved heat transfer rate for the heat transfer surface.

The nucleate boiling process can be enhanced by configuring the heat transfer surface so that it has nucleation sites that provide locations for the entrapment of vapor and promote the formation of vapor bubbles. Simply roughening a heat transfer surface, for example, will provide nucleation sites that can improve the heat transfer characteristics of the surface over a similar smooth surface. Nucleation sites of the re-entrant type produce stable bubble columns and good surface heat transfer characteristics. A re-entrant type nucleation site is a surface cavity in which the opening of the cavity is smaller than the subsurface volume of the cavity. An excessive influx of the surrounding liquid can flood a re-entrant type nucleation site and deactivate it. By configuring the heat transfer surface so that it has relatively larger communicating subsurface channels with relatively smaller openings to the surface, flooding of the vapor entrapment or nucleation sites can be reduced or prevented and the heat transfer performance of the surface improved.

In a falling film type evaporator, spreading of liquid film on the heat transfer surface and promotion of a thin film are important to improve the ability to transfer heat.

It is desirable from a logistics and manufacturing point of view to have a heat transfer tube with an external heat transfer surface that has good heat transfer performance in both refrigerant condensing and evaporating applications in the flooded and falling film evaporator modes so that a single tube configuration may be used in both condensers and flooded evaporators.

SUMMARY OF THE INVENTION

The present invention is a method of manufacturing a heat transfer tube having an external surface configured to provide improved heat transfer performance in both refrigerant condensing, flooded evaporation and film evaporation applications.

The tube has one or more fin convolutions formed on its external surface. Notches extend at an oblique angle across the fin convolutions at intervals about the circumference of the tube. The portion of a fin convolution between adjacent notches in the fin convolution forms a spike. The distal tip of the spike is split into two tip portions. Each tip portion extends outward from the proximal base of the fin toward the split fin tips in the adjacent fin convolution.

The notches and split spike tips further increase the outer surface area of the tube as compared to a conventional finned tube. The grooves between adjacent fin convolutions, over which the split fin tips extend form reentrant cavities that promote refrigerant pool boiling in a flooded evaporator.

In condensing and falling film evaporation applications, the relatively sharp spike tips promote drainage and spreading of refrigerant from the fin. In most installations, the tubes in a shell and tube type air conditioning heat exchanger run horizontally or nearly so. With horizontal tubes, the notched and split fin configuration promotes drainage of condensing refrigerant from the fins into the grooves between fins on the upper portion of the tube surface and also promotes drainage of condensed refrigerant off the tube on the lower portion of the tube surface. In film evaporation mode, the sharp tips and notches, and low surface tension of refrigerant aid in liquid spreading on the tube surface and along the tube axis. This promotes good wettability in a horizontal shell and tube falling film evaporator.

Manufacture of a notched split tip finned tube is easily and economically accomplished by adding a notching disk or disks and a splitter disk or disks to the tool gang of a finning machine of the type that forms fins on the outer surface of a tube by rolling the tube wall between an internal mandrel and external finning disks. The notching tool is configured to impart a twist to the sound spikes in order to facilitate splitting of the spike tips.

BRIEF DESCRIPTION OF THE DRAWINGS

The accompanying drawings form a part of the specification. Throughout the drawings, like reference numbers identify like elements.

DESCRIPTION OF THE PREFERRED EMBODIMENTS

Figure 1:
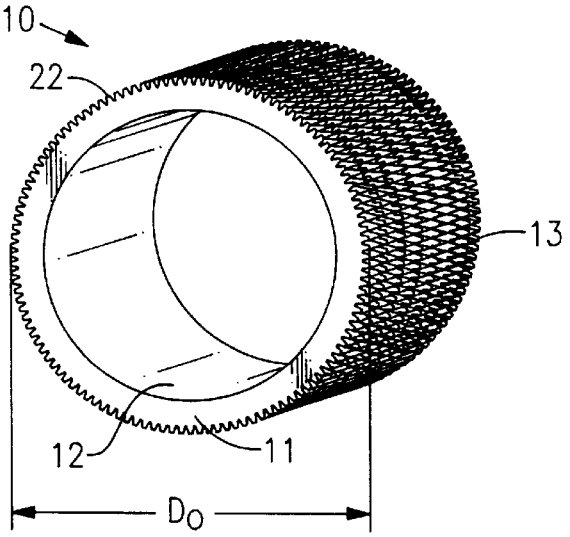
FIG. 1 is a pictorial view of the tube of the present invention.

FIG. 1 is a pictorial view of heat transfer tube 10. Tube 10 comprises tube wall 11, tube inner surface 12 and tube outer surface 13. Extending from the outer surface of tube wall 11 are external fin spikes 22. Tube 10 has an outer diameter $D_o$ as measured from tube outer surface 13 excluding the height ($H_f$) of fin spikes 22.

Figure 2:
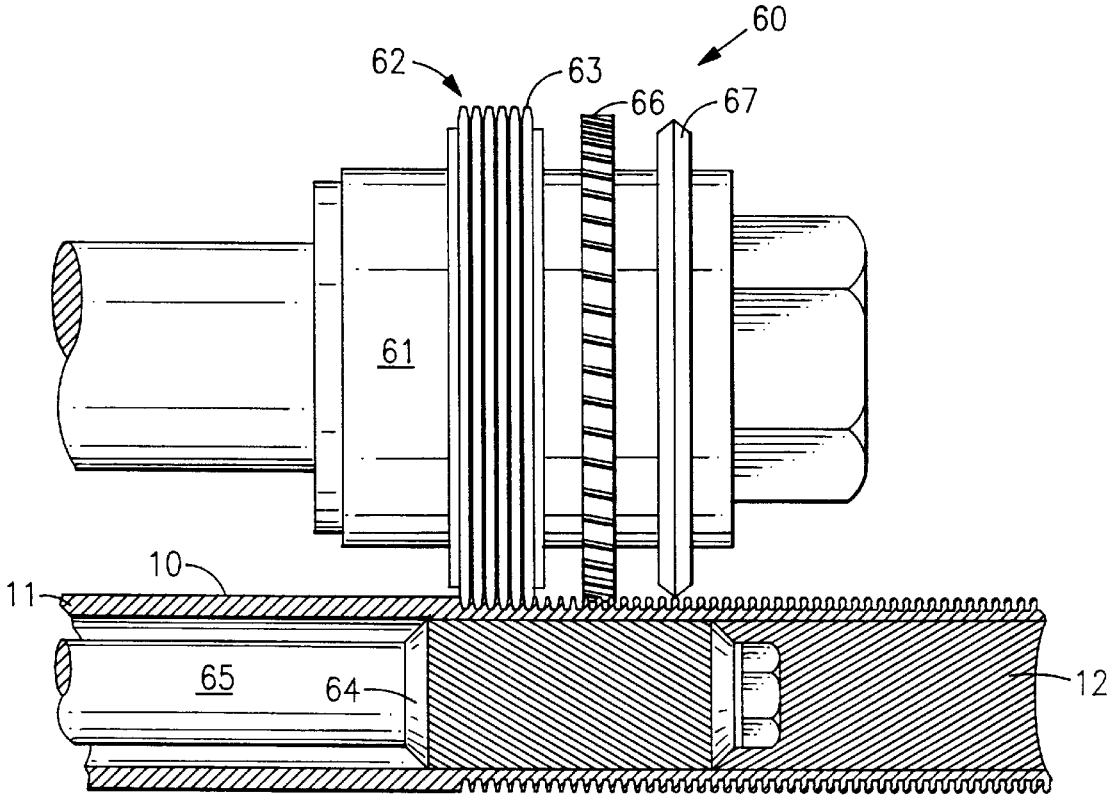
FIG. 2 is a view illustrating how the tube of the present invention is manufactured.

The tube of the present invention may be readily manufactured by a rolling process. FIG. 2 illustrates such a process. In FIG. 2, finning machine 60 is operating on tube 10, which is made of a malleable metal such as copper, to produce both interior ribs and exterior fins on the tube. Finning machine 60 has one or more tool arbors 61, each containing a tool gang 62, comprised of a number of finning disks 63, notching disk 66 and splitting disk 67. Extending into the tube is mandrel shaft 65 to which is attached mandrel 64.

Wall 11 is pressed between mandrel 64 and finning disks 63 as tube 10 rotates. Under pressure, metal flows into the grooves between the finning disks and forms a ridge or fin on the exterior surface of the tube. As it rotates, tube 10 advances between mandrel 64 and tool gang 62 (from left to right in FIG. 2) resulting in a number of helical fin convolutions being formed on the tube. The number of convolutions is a function of the number of finning disks 63 in tool gang 62 and the number of tool arbors 61 in use on finning machine 60. In the same pass and just after tool gang 62 forms fin convolutions on tube 10, notching wheel 66 impresses oblique notches in to the metal of the fin convolutions. Following formation of the oblique notches, splitting disk 67 splits the tip of each fin convolution into two portions.

Mandrel 64 may be configured in such a way, as shown in FIG. 2, that it will impress some type of pattern into the internal surface 12 of the wall of the tube passing over it. A typical pattern is of one or more helical rib convolutions. Such a pattern can improve the rate of heat transfer between the fluid flowing through the tube and the tube wall.

Figure 3:
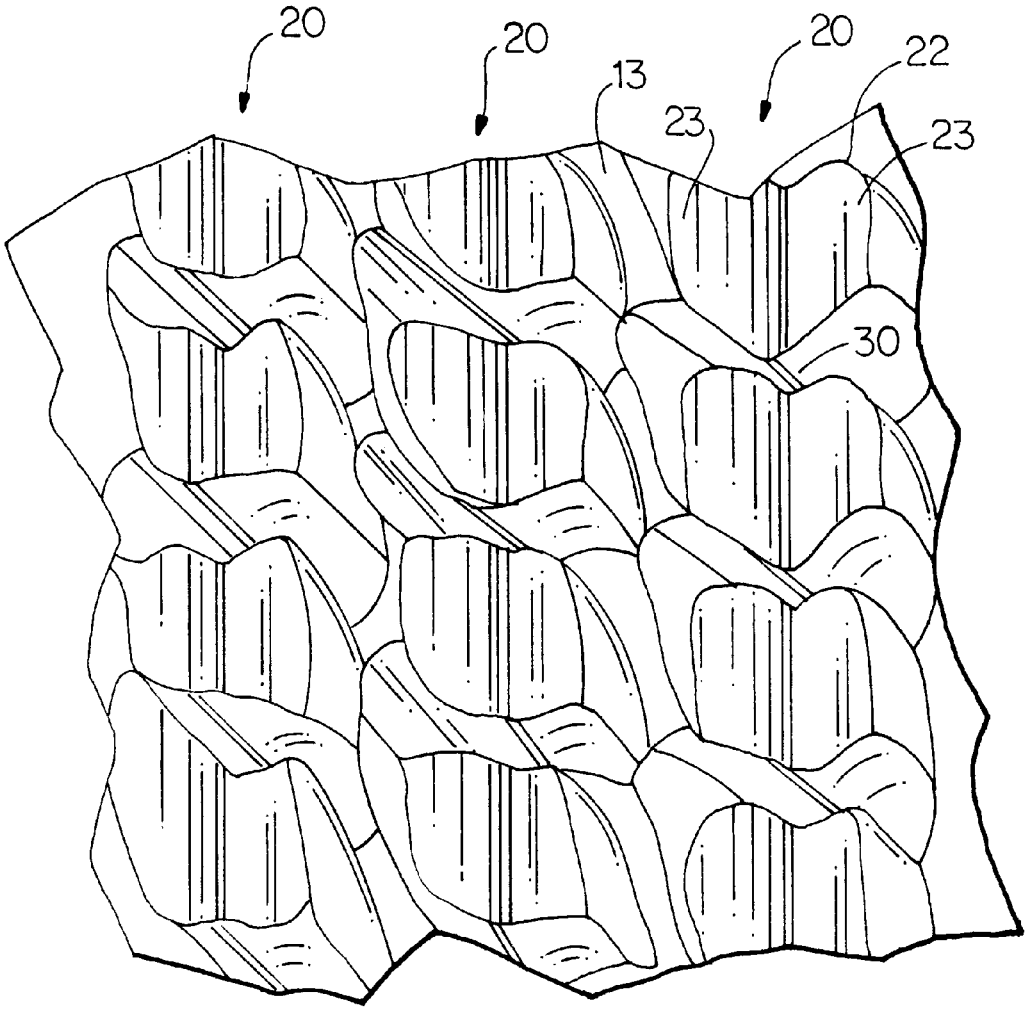
FIG. 3 is a plan view of a portion of the external surface of the tube of the present invention.

FIG. 3 shows, in plan view, a portion of the external surface of the tube. Extending from outer surface 13 of tube 10 are a number of fin convolutions 20. Extending obliquely across each fin convolution at intervals are a pattern of notches 30. Between each pair of adjacent notches in a given fin convolution is a fin spike 22 having two distal tips 23.

Figure 4:
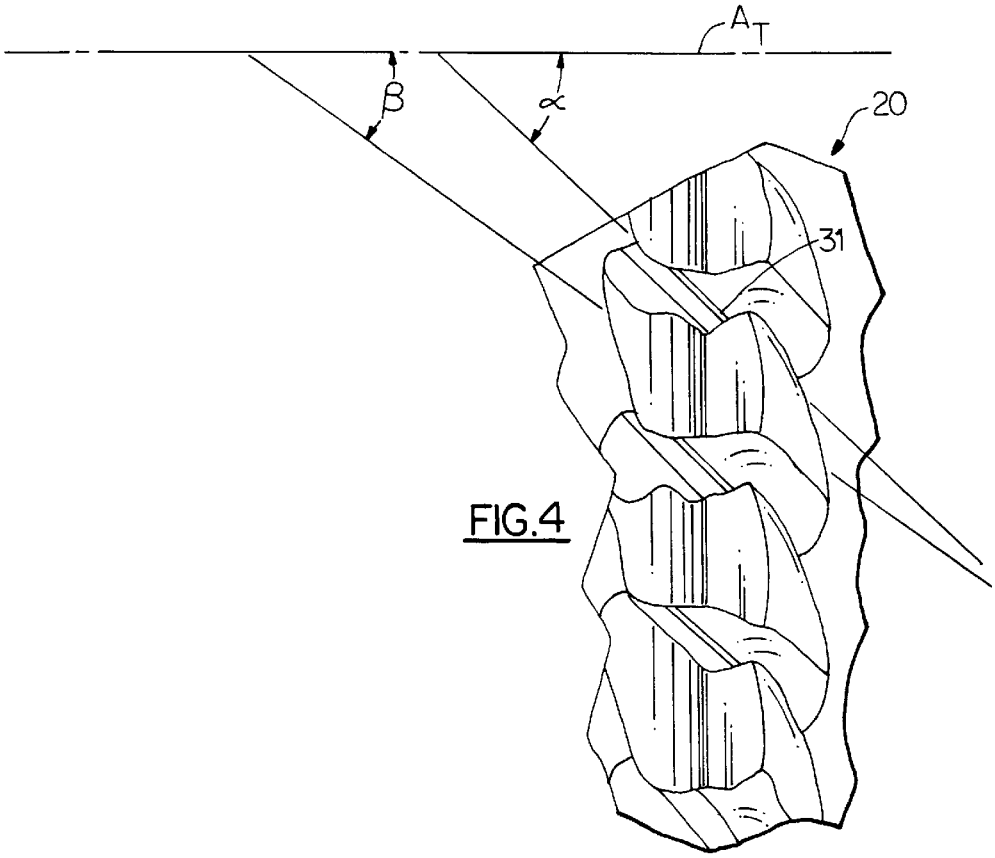
FIG. 4 is a plan view of a portion of a single fin convolution of the tube of the present invention.

FIG. 4 is a plan view of a portion of a single fin convolution of the tube of the present invention. The angle of inclination of notch base 31 from tube longitudinal axis $A_T$ is angle $\alpha$. The angle of inclination of the distal tip 23 of fin 22 from longitudinal axis of the tube $A_T$ is angle $\beta$. During manufacture of the tube (see FIG. 2) the interaction between rotating and advancing tube 10 and notching wheel 66, may result in the axis of fin spike 22, indicated in FIG. 4, is turned slightly from the angle between the teeth of the notching wheel and the fin convolution so that tip axis angle $\beta$ is oblique with respect to angle $\alpha$, i.e., $\beta \neq \alpha$. However, it is possible to have $\beta = \alpha$ as a specific case. It is this turning of the spike that allows the splitting disk 67 to reliably split the spike because the notched spike presents a wider face for splitting than would the un-notched fin convolution.

It has been found that if the angle of the notching wheel is greater than 40° and the spacing between adjacent teeth on the notching wheel is less than 0.0125 each, the spikes will be caused to twist. The twisting of the spikes enables the splitting of the spikes to be done more efficiently. Specifically, without the twisting, the fin tip thickness would be too small to reliably split the spikes. With the twist the shape of the spikes after notching and just before splitting is essentially a parallelogram. After splitting the parallelogram is split along its diagonal to create two triangles.

Figure 5:
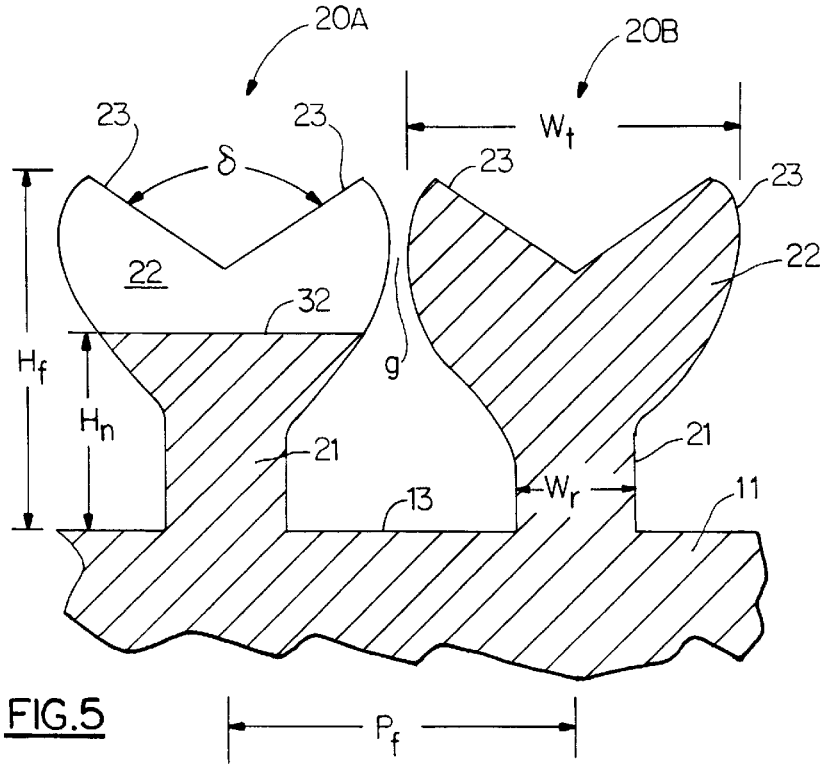
FIG. 5 is a generic sectioned elevation view of two adjacent fin convolutions of the tube of the present invention.

FIG. 5 is a pseudo sectioned elevation view of two adjacent fin convolutions of the tube of the present invention. The term pseudo is used because it is unlikely that a section taken through any part of the fin convolutions would look exactly as the section depicted in FIG. 5. The figure, however, serves to illustrate many of the features of the tube. Fin convolutions 20A and 20B extend outward from tube wall 11. Fin convolutions 20A and 20B have proximal portions 21 and spike portions 22. Extending through fin convolution 20A is a notch having notch base 32. The overall height of fin convolutions 20A and 20B is $H_f$. The width of proximal portion 21 is $W_r$ and the width of spike portion 22 at its widest dimension is $W_t$. The outer extremity of spike 22 has two distal tips 23. The notch penetrates into the fin convolution to height $H_n$ above inner wall surface 13.

It should be understood that notching wheel 66 (FIG. 2) does not cut notches out of the fin convolutions during the manufacturing process but rather impresses notches into the fin convolutions by displacing material from the notched area. The excess material from the notched portion of the fin convolution moves both into the region between adjacent notches and outwardly from the sides of the fin convolution as well as toward tube wall 11 on the sides of the fin convolution. As a result, $W_t$ is greater than $W_r$. The distance between similar points on adjacent fin convolutions, or fin pitch is $P_f$. The angle between the two distal tips 23 on a spike portion 22, or split angle, is angle $\delta$. A distal tip extending from one side of a fin convolution extends toward the adjacent fin convolution on that side leaving gap g between tips.

The relatively large number of sharp distal tips promote condensation on the surface of the tube when the tube is used in a condensing application. Because the distal tips overlie the volume between adjacent fin convolutions, a reentrant cavity is formed and thus forms a tube surface that promotes evaporation.

We have tested two families of prototype tubes made according to the teaching of the present invention using refrigerant R-134*a*. The pertinent parameters of the two prototypes are:

Prototype Family A nominal outer diameter ($D_o$)—1.9 cm (¾ inch),
fin pitch ($P_f$)—0.6 mm (0.024 inch) or 16.5 fins per cm (42 fins per inch),
fin height ($H_f$)—0.79 mm (0.031 inch),
notch base height ($H_n$)—0.58 mm (0.023 inch),
notch angle ($\alpha$)—50 degrees, 30 degrees, 45 degrees
split angle ($\delta$)—70 degrees, 90 degrees, 110 degrees
notch density, or number of notches in a fin convolution per tube circumference—80, 140.

Prototype Family B nominal outer diameter ($D_o$)—1.9 cm (¾ inch),
fin pitch ($P_f$)—0.45 mm (0.018 inch) or 22 fins per cm (56 fins per inch),
fin height ($H_f$)—0.58 mm (0.024 inch),
notch base height ($H_n$)—0.35 mm (0.014 inch),
notch angle ($\alpha$)—50 degrees
split angle ($\delta$)—90 degrees, and
notch density, or number of notches in a fin convolution per tube circumference—140.

We compared the performance of the two prototypes to the performance of a tube having a smooth external surface over a range of heat flux conditions. In an evaporation application, the performance of Prototype Family A is an average of about 2.5 times that of the smooth tube and the performance of Prototype Family B is about 3 times the smooth tube performance. In a condensing application, the performance of Prototype Family A is an average of about 19 times that of the smooth tube and the performance of Prototype Family B is about 23 times the smooth tube performance.

Extrapolations from test data indicate that comparable performance will be obtained in tubes having nominal 12.5 millimeter (½ inch) to 25 millimeter (1 inch) outer diameters where:

a) the fin pitch is 0.38 to 0.76 millimeter (0.015 to 0.030 inch), or $$0.38\text{ mm} \leqq P_f \leqq 0.76\text{ mm } (0.015\text{ inch} \leqq P_f \leqq 0.030\text{ inch});$$

b) the ratio of fin height to tube outer diameter is between 0.026 and 0.067, or $$0.026 \leqq H_f/D_o \leqq 0.067;$$

c) the notch density is 60 to 190;

d) the angle between the notch axis and the tube longitudinal axis is between 20 and 65 degrees, or $$20° \leqq \alpha \leqq 65°$$

e) the height of the notch base is between 0.50 and 0.8 of the fin height or $$0.50 \leqq H_n/H_f \leqq 0.8.$$

and f) the angle between the two distal tips on a spike is between 70 and 130 degrees, or $$70° \leqq \delta \leqq 130°.$$

The tested prototypes have three convolutions or "starts." The optimum number of fin convolutions or starts depends more on considerations of ease of manufacture than upon the effect of the number on heat transfer performance. A higher number of starts increases the rate at which the fin convolutions can be formed on the tube surface.

We claim:

1. A method of forming a heat transfer surface on an exterior wall of a tube comprising the steps of:

supporting the interior of said tube with an internal mandrel;

pressing a gang of rotating finning disks against the exterior wall of said tube to form a fin convolution, and to cause said tube to rotate and axially advance with respect to said disks;

simultaneously performing the steps of:

notching said fin convolution, on said advancing and rotating tube, at intervals about the circumference of said tube to form spikes in said fin convolution, each of said spikes having a proximal end formed integrally with said tube wall and a distal end; and twisting said spikes so that said distal end is angularly disposed relative to said proximal end; and splitting said distal ends of said spikes to form two distal tips in each spike.

* * * * *